US011575213B2

(12) United States Patent
Wright et al.

(10) Patent No.: US 11,575,213 B2
(45) Date of Patent: Feb. 7, 2023

(54) ANTENNA COVER AND METHODS OF RETENTION

(71) Applicant: CommScope Technologies LLC, Hickory, NC (US)

(72) Inventors: Alastair Wright, Edinburgh Lothian (GB); Lawrence Bissett, Fife (GB); John Curran, Fife (GB); Shuwei Russell, Central Scotland (GB)

(73) Assignee: CommScope Technologies LLC, Hickory, NC (US)

( * ) Notice: Subject to any disclaimer, the term of this patent is extended or adjusted under 35 U.S.C. 154(b) by 502 days.

(21) Appl. No.: 16/334,681

(22) PCT Filed: Sep. 1, 2017

(86) PCT No.: PCT/US2017/049877
§ 371 (c)(1),
(2) Date: Mar. 19, 2019

(87) PCT Pub. No.: WO2018/057275
PCT Pub. Date: Mar. 29, 2018

(65) Prior Publication Data

US 2021/0288413 A1 Sep. 16, 2021

Related U.S. Application Data

(60) Provisional application No. 62/398,691, filed on Sep. 23, 2016.

(51) Int. Cl.
*H01Q 19/12* (2006.01)
*H01Q 1/42* (2006.01)
(Continued)

(52) U.S. Cl.
CPC ..... *H01Q 19/12* (2013.01); *H01Q 1/421* (2013.01); *H01Q 17/001* (2013.01); *H01Q 19/022* (2013.01)

(58) Field of Classification Search
CPC ..... H01Q 1/42; H01Q 1/12; H01Q 15/14; H01Q 1/22; H01Q 17/00; H01Q 19/02;
(Continued)

(56) References Cited

U.S. PATENT DOCUMENTS 9,352,877 B2 * 5/2016 Furlong ..... A47J 47/10
9,583,823 B2 * 2/2017 Tasker ..... H01Q 1/427
(Continued)

FOREIGN PATENT DOCUMENTS

WO 2015/134086 9/2015

OTHER PUBLICATIONS

International Search Report and Written Opinion corresponding to International Application No. PCT/US2017/049877 dated Nov. 29, 2017.

(Continued)

*Primary Examiner* — Andrea Lindgren Baltzell
(74) *Attorney, Agent, or Firm* — Myers Bigel, P.A.

(57) ABSTRACT

A radome-reflector assembly includes a generally domed reflector having a peripheral rim and a radome assembly. The radome assembly includes: an annular ring having a front wall and a side wall: a disk that fits within the ring: and an RF-compliant absorber, wherein the rim of the reflector fits within the side wall. The radome assembly further comprises a clip that engages the rim and the ring to secure the reflector to the radome assembly.

7 Claims, 9 Drawing Sheets

(51) Int. Cl.
*H01Q 17/00* (2006.01)
*H01Q 19/02* (2006.01)

(58) Field of Classification Search
CPC .... H01Q 19/12; H01Q 17/001; H01Q 19/022; F16B 2/06; F16B 21/00; H01P 11/00
See application file for complete search history.

(56) References Cited

U.S. PATENT DOCUMENTS

| | | | | |
|---|---|---|---|---|
| 2005/0035923 | A1* | 2/2005 | Syed | H01Q 19/022 343/872 |
| 2005/0190116 | A1* | 9/2005 | Syed | H01Q 19/022 343/872 |
| 2009/0295677 | A1 | 12/2009 | Gratton et al. | |
| 2013/0082896 | A1* | 4/2013 | Renilson | H01Q 1/42 343/872 |
| 2013/0099991 | A1* | 4/2013 | Wright | H01Q 1/42 343/840 |
| 2016/0149297 | A1 | 5/2016 | Tasker et al. | |
| 2016/0294050 | A1* | 10/2016 | Renilson | H01Q 1/428 |

OTHER PUBLICATIONS

Extended European Search Report corresponding to European Application No. 17853658.7 dated Mar. 20, 2020.
International Search Report and Written Opinion corresponding to International Application No. PCT/US2017/049877, dated Apr. 4, 2019.

* cited by examiner

ANTENNA COVER AND METHODS OF RETENTION

RELATED APPLICATIONS

The present application is a 35 U.S.C. § 371 national phase application of and claims prior ay to PCT Application PCT/US2017/049877 filed Sep. 1, 2017, which claims priority from and the benefit of U.S. Provisional Application No. 62/398,691, filed Sep. 23, 2016, the disclosure of each of which is hereby incorporated herein by reference in its entirety.

FIELD OF THE INVENTION

The present invention relates to microwave reflector antennas. More particularly, the invention relates to a reflector antenna with a radome.

BACKGROUND

The open end of a reflector antenna is typically enclosed by a radome coupled to the distal end of the reflector dish. The radome provides environmental protection and improves wind load characteristics of the antenna.

Precision shaping may be applied to the radome to compensate for signal trajectory and/or reflection effects resulting from an impedance discontinuity introduced into the signal path of the reflector antenna by the presence of the radome. Edge(s) of the radome attachment arrangement scatter the radio frequency (RF) signal, which can degrade the signal pattern. For example, edges and/or channel paths of the reflector dish, radome and/or interconnection hardware may diffract or enable spill-over of signal energy present in the areas, introducing undesirable backlobes into the reflector antenna signal pattern quantified as the front to back ratio (F/B) of the antenna. As such, the technique used to attach the radome to the reflector can be critical to antenna performance.

SUMMARY

As a first aspect, embodiments of the invention are directed to a radome-reflector assembly comprising a generally domed reflector having a peripheral rim and a radome assembly attached to the reflector. The radome assembly comprises: an annular ring having a front wall and a side wall; a disk that fits within the ring; and an RF-compliant absorber. The rim of the reflector fits within the side wall. The assembly further comprises a clip that engages the rim and the ring to secure the reflector to the radome assembly.

As a second aspect, embodiments of the invention are directed to a radome-reflector assembly comprising a generally domed reflector having a peripheral rim and a radome assembly attached to the reflector. The radome assembly comprises: an annular ring having a front wall and a side wall; a disk that fits within the ring; and an RF-compliant absorber. The rim of the reflector fits within the side wall, and the annular ring includes a feature that engages the rim of the reflector to secure the reflector to the radome assembly.

DETAILED DESCRIPTION

Figure 1:
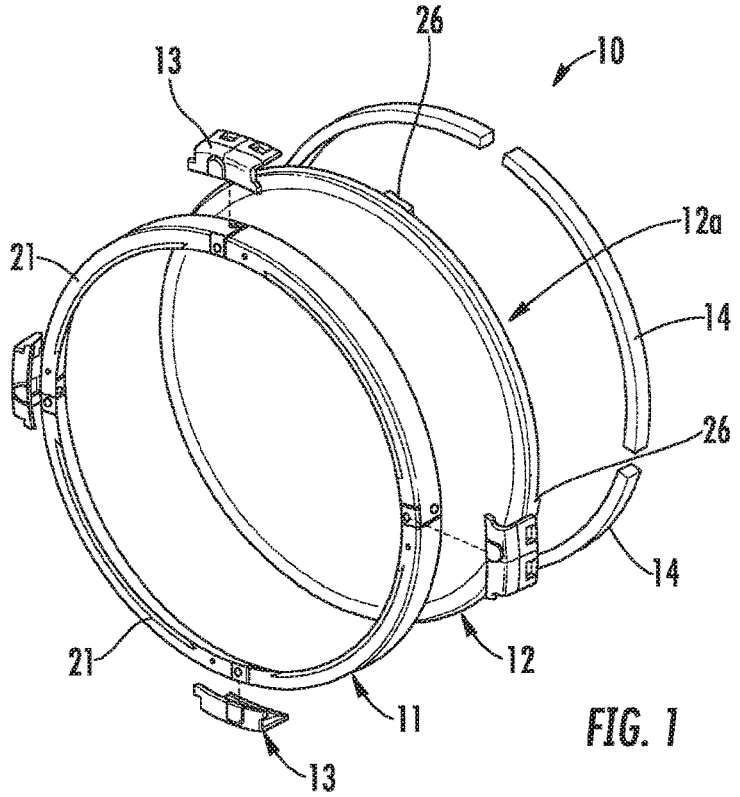
FIG. 1 is an exploded perspective view of a radome assembly according to embodiments of the present invention.

In the following detailed description, numerous specific details are set forth to provide a thorough understanding of embodiments of the present disclosure. However, it will be understood by those skilled in the art that the present invention may be practiced without these specific details. In some instances, well-known methods, procedures, components and circuits have not been described in detail so as not to obscure the present disclosure. It is intended that all embodiments disclosed herein can be implemented separately or combined in any way and/or combination. Aspects described with respect to one embodiment may be incorporated in different embodiments although not specifically described relative thereto. That is, all embodiments and/or features of any embodiments can be combined in any way and/or combination.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Like reference numbers signify like elements throughout the description of the figures.

Embodiments are described herein with reference to cross-sectional and perspective views that are schematic illustrations of idealized embodiments. As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. Therefore, regions illustrated in the drawings are schematic in nature, and their shapes are not intended to limit the inventive concept.

The thicknesses of elements in the drawings may be exaggerated for the sake of clarity. Further, it will be understood that when an element is referred to as being "on" another element, the element may be formed directly on the other element, or there may be an intervening layer therebetween.

Terms such as "top," "bottom," "upper," "lower," "above," "below," and the like are used herein to describe the relative positions of elements or features. For example, when an upper part of a drawing is referred to as a "top" and a lower part of a drawing is referred to as a "bottom" for the sake of convenience, in practice, the "top" may also be called a "bottom" and the "bottom" may also be a "top" without departing from the teachings of the inventive concept.

Furthermore, throughout this disclosure, directional terms such as "upper," "intermediate," "lower," and the like may be used herein to describe the relationship of one element or feature with another, and the inventive concept should not be limited by these terms. Accordingly, these terms such as "upper," "intermediate," "lower," and the like may be replaced by other terms such as "first," "second," "third," and the like to describe the elements and features.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

The terminology used herein to describe embodiments of the invention is not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Figure 2:
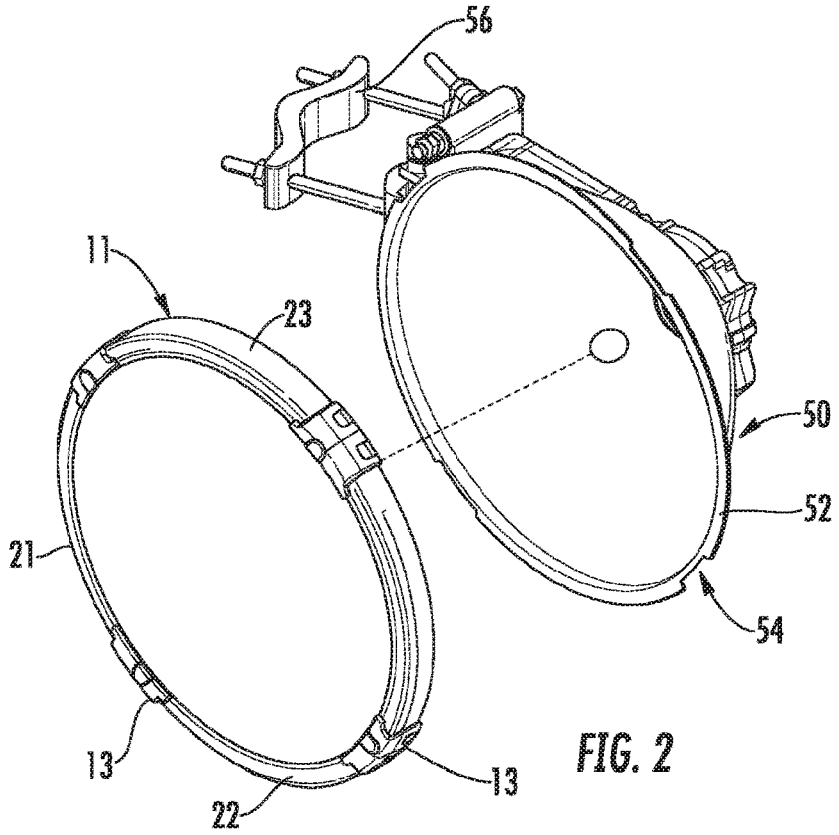
FIG. 2 is an exploded perspective view of the radome assembly of FIG. 1 and a reflector.

Referring now to the figures, a radome assembly 10 is shown in FIGS. 1 and 2. The radome assembly 10 includes an annular ring 11, an RF compliant disc 12, and four quarter-circular absorbers 14. These components are discussed below.

In the illustrated embodiment, the annular ring 11 is formed of four separate quarter-circle quadrants 21, each having an L-shaped profile with a front panel 22 and a side panel 23. The quadrants 21 are attached at their ends with overlapping joints (see FIG. 5, wherein front panel 22' of one quadrant 21 overlies front panel 22" of another quadrant 21); attachment of the adjacent quadrants 21 may be achieved with screws, rivets or other fasteners to form the annular structure. The ring 11 is typically formed of a metallic material.

The RF-compliant disk 12 is circular and sized to fit generally within the outer edges of the ring 11. On its underside, the disk 12 includes four recesses 12*a*, each of which extends about the periphery of the disk 12 between two respective alignment protrusions 26. The disk 12 may be formed of any RF-compliant material.

As noted above, each of the absorbers 14 extends in an arc of approximately a quarter-circle. The absorbers 14 are generally rectangular in cross-section. The absorbers 14 may be formed of any material that can help to reduce RF leakage from the assembly.

The radome assembly 10 may be attached to a reflector 50 as shown in FIG. 2. The reflector 50, which is domed toward the rear, has a peripheral rim 52 with four circumferentially equidistant cutouts 54. As can be seen in FIG. 2, the reflector 50 is attached to a clamp mount 56 that in turn can be used to mount the reflector 50 to an antenna tower or other mounting structure.

Figure 3:
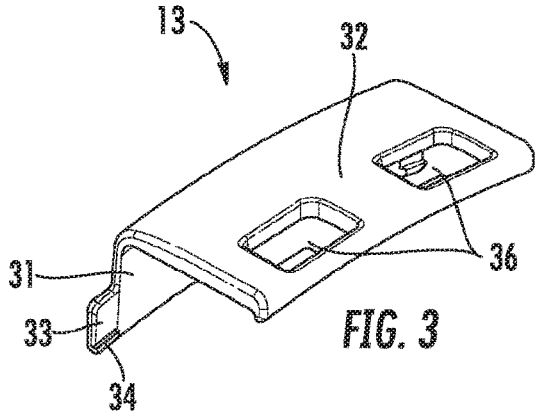
FIG. 3 is a top perspective view of a clip used to secure the radome assembly and reflector of FIG. 2.
Figure 4:
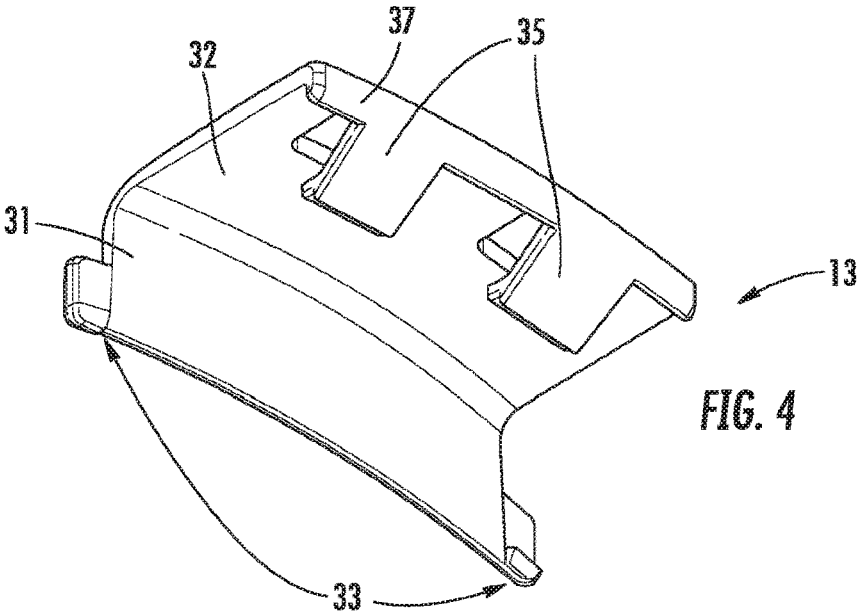
FIG. 4 is a bottom perspective view of the clip of FIG. 3.

The radome assembly 10 is secured via four retaining clips 13 (see FIGS. 3 and 4). Each of the four retaining clips 13 includes a front panel 31 and a side panel 32 that are disposed generally perpendicular to each other. Two fingers 33 extend from the lower side edges of the front panel 31. Each of the fingers 33 includes a hook 34 that extends rearwardly. A rear lip 37 depends from the rear edge of the side panel 32. Two latches 35 extend forwardly from the rear lip 37 at an angle relative to the side panel 32 (typically between about 30 and 60 degrees). The side panel 32 has two holes 36 aligned with the latches 35 that facilitate the formation of the latches 35 in an injection molding process.

The clip 13 may be made of a number of suitable materials. In some embodiments, the clip 13 may be formed of a polymeric material.

Figure 5:
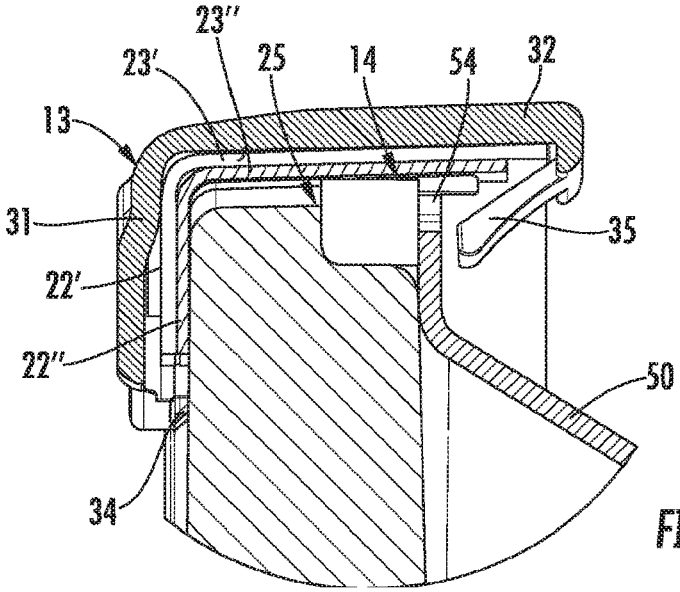
FIG. 5 is an enlarged partial side section view of the radome assembly and reflector of FIG. 2 in an assembled condition.
Figure 6:
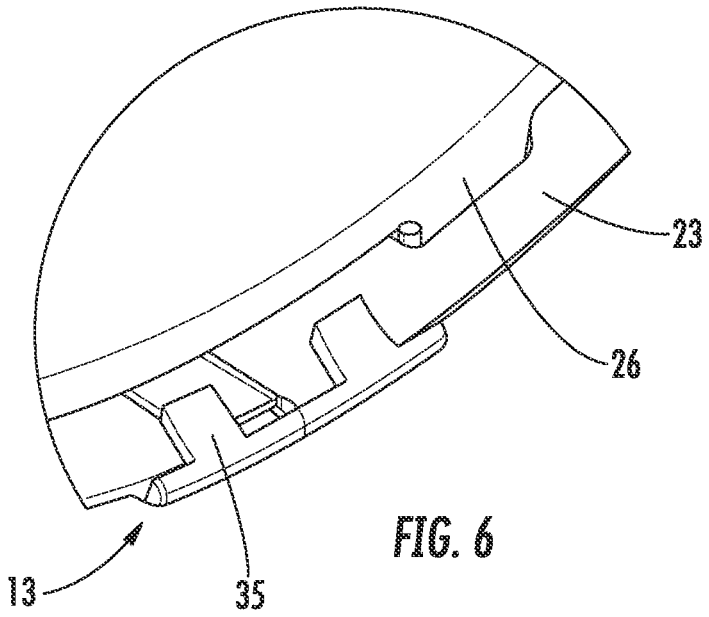
FIG. 6 is an enlarged bottom partial perspective view of the radome assembly and reflector of FIG. 5.

The radome assembly 10 may be assembled by positioning the disk 12 within the annular ring 11 (see FIGS. 1, 5 and 6). The absorbers 14 are positioned in a gap 25 formed between the inner diameter at the side panels 23 of the ring 11 and the outer diameter of the disk 12. The alignment protrusions 26 of the disk 12 are positioned between the ends of adjacent absorbers 14. The clips 13 are then used to secure the assembly 10 as a unit. More specifically, each of the clips 13 is positioned so that the latches 35 and the side panel 32 sandwich the side panel 23 of the annular ring 11 (see FIG. 5, wherein side panels 23', 23" are shown, and FIG. 6). The clips 13 are positioned over respective overlapping joints of the ring 11. Each clip 13 is then rotated until the front panel 31 of the clip 13 overlies the front panel 22 of the ring 11.

As can be seen in FIG. 5, the ring 11 has a double thickness at the overlapping joints, with the front panel 22' of one quadrant overlying the front panel 22" of the other quadrant. The hooks 34 on the fingers 33 slip under the overlying front panel 22' and adjacent the underlying front panel 22" to secure the clip 13 in place on the ring 11.

Figure 7:
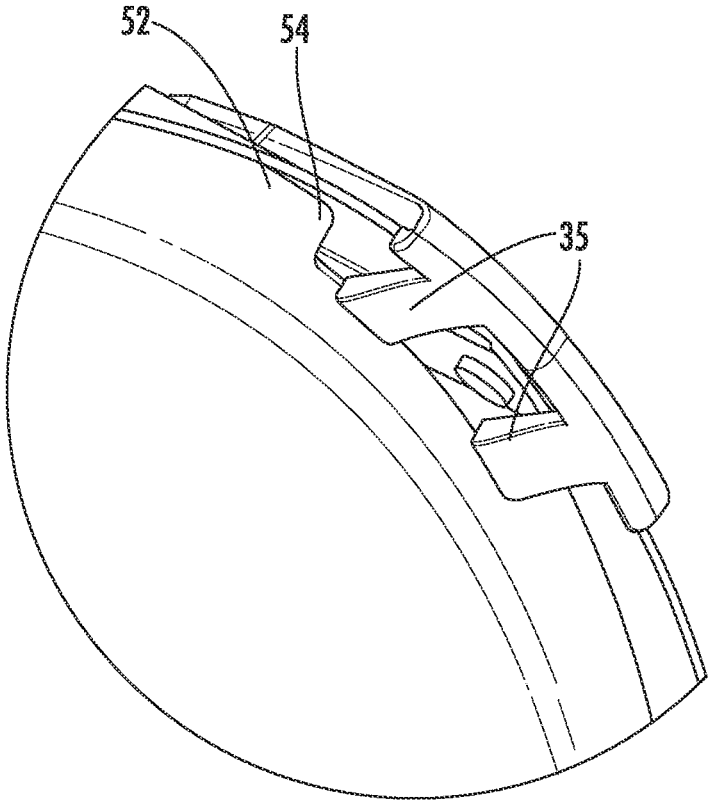
FIG. 7 is a reverse bottom partial perspective view of the radome assembly and reflector of FIG. 5.
Figure 8:
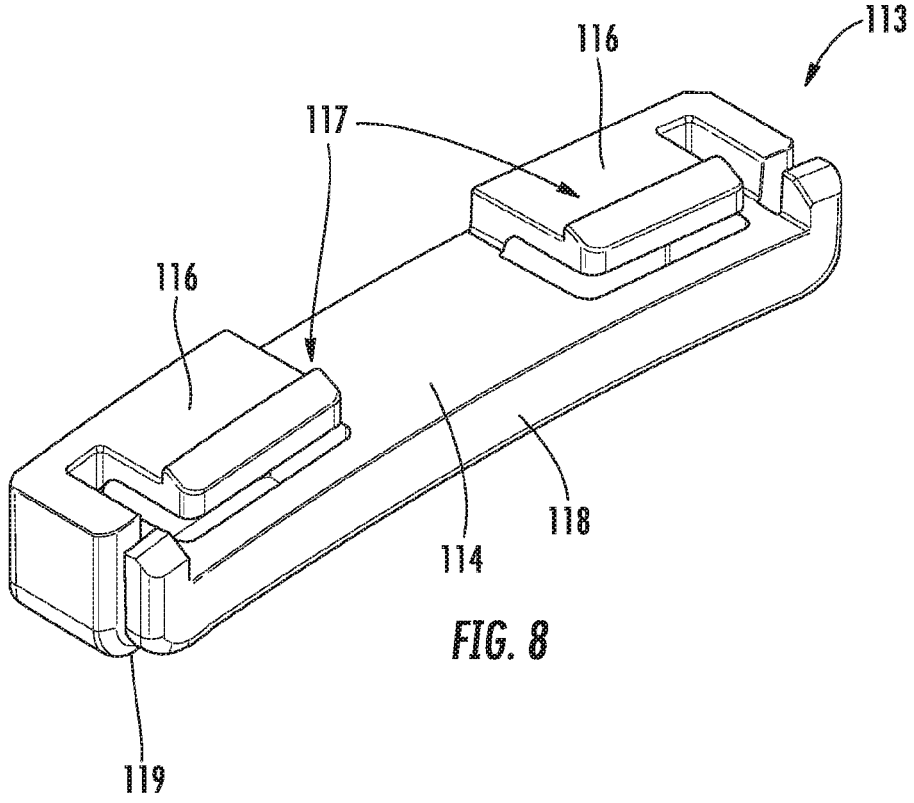
FIG. 8 is a top perspective view of a clip to secure a radome assembly and a reflector according to embodiments of the invention.
Figure 9:
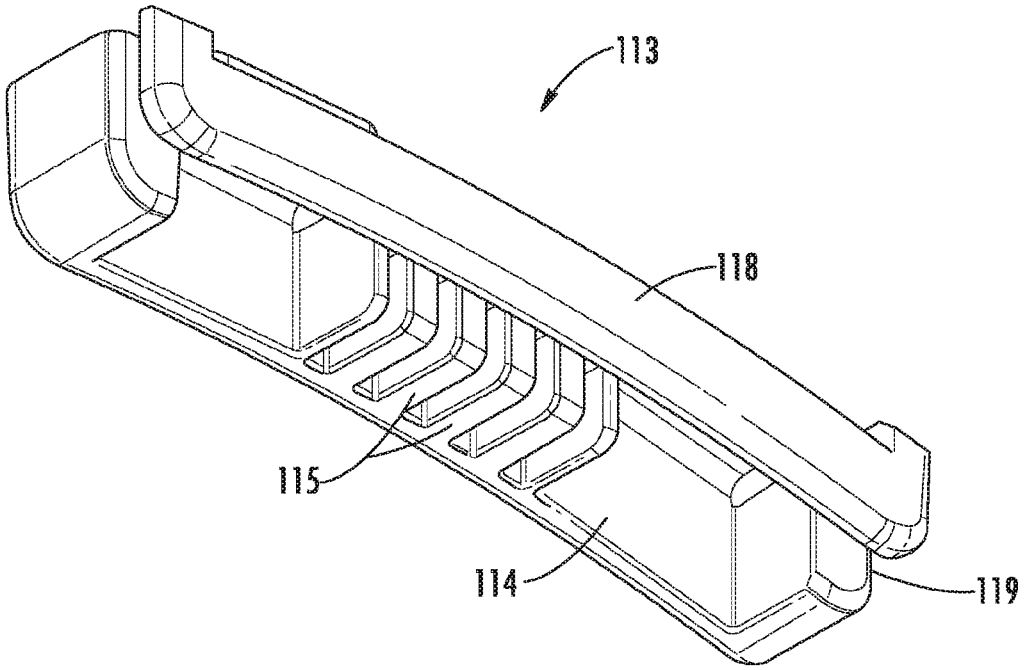
FIG. 9 is a bottom perspective view of the clip of FIG. 8.
Figure 10:
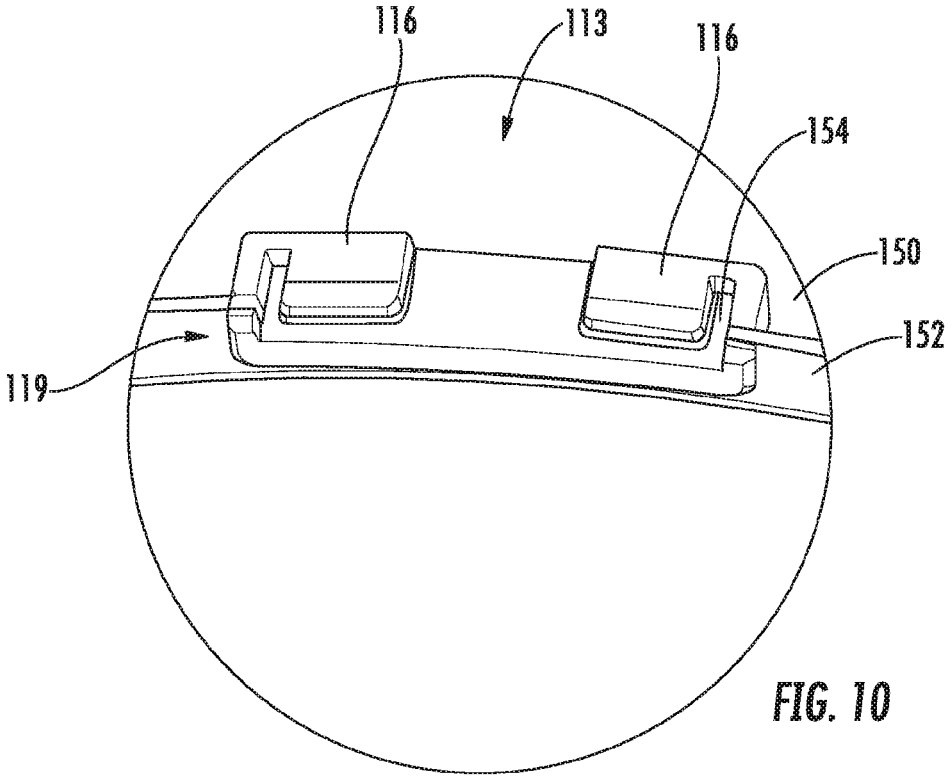
FIG. 10 is a top perspective view of the clip of FIG. 8 in place on a reflector.
Figure 11:
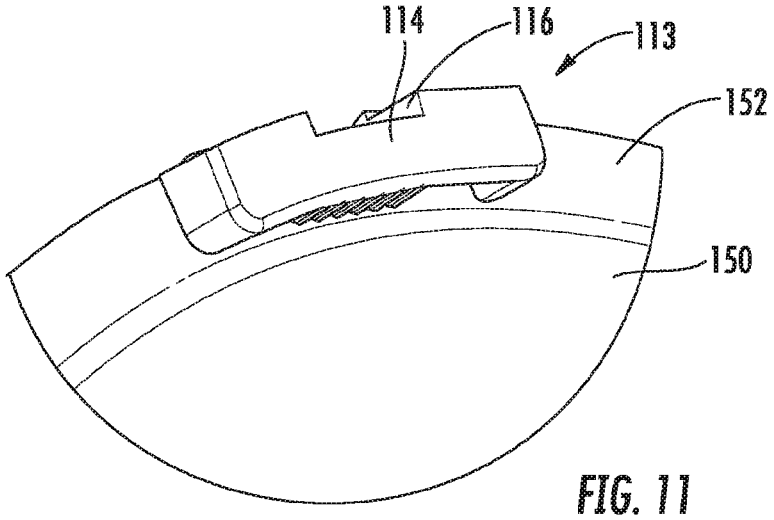
FIG. 11 is a bottom perspective view of the clip and reflector of FIG. 10.
Figure 12:
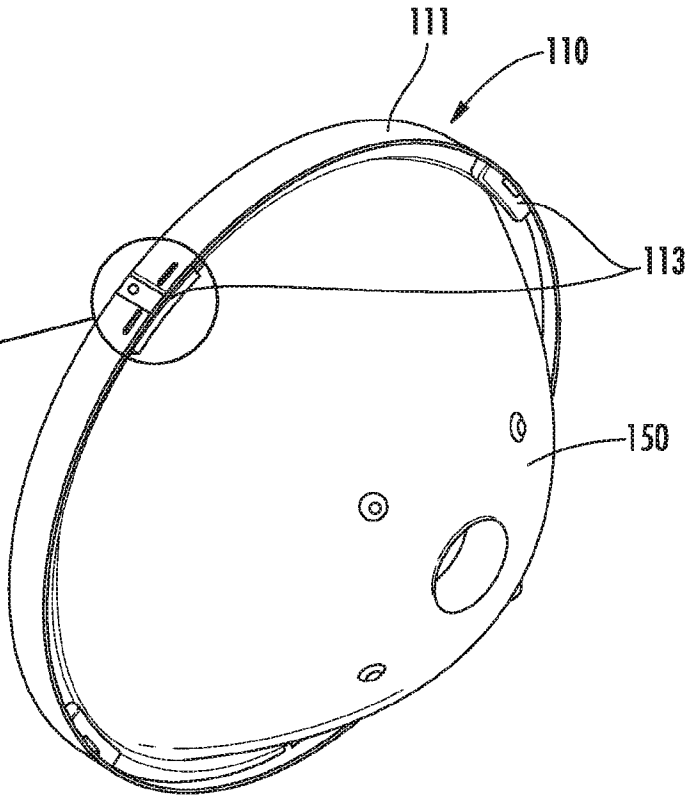
FIG. 12 is a perspective view of a reflector and radome assembly held in place with the clip of FIG. 8.
Figure 12A:
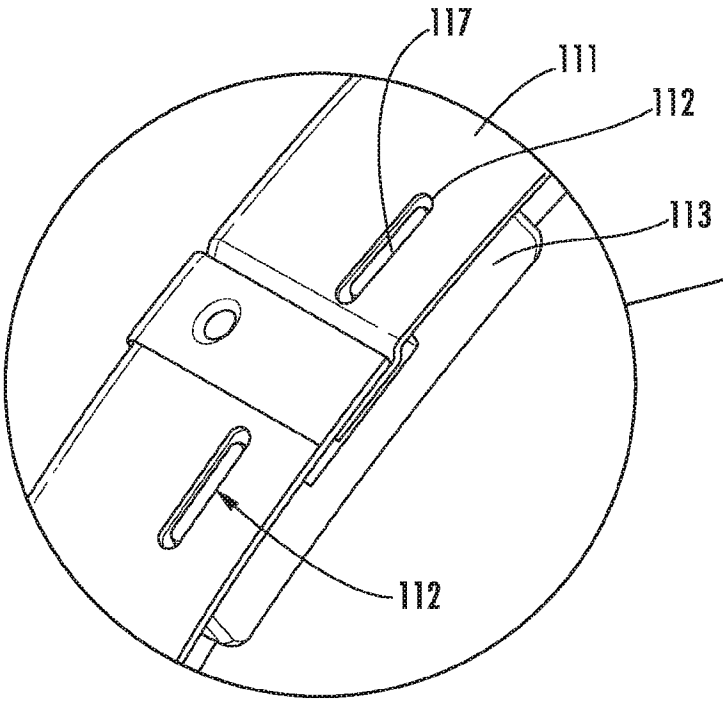
FIG. 12A is an enlarged partial perspective view of the reflector, radome and clip of FIG. 12.

To assemble the radome assembly 10 onto the reflector 50, the clips 13 are aligned with the cutouts 54 in the rim 52 (see FIGS. 2 and 7). The radome assembly 10 is then pushed onto the reflector 50, with the latches 35 deflecting radially outwardly upon engagement with the rim 52. Once the latches 35 pass the reflector rim 52, they recover to their undeflected position and capture the reflector 50. Also, the rearmost edge of the ring 11 is located a specified distance behind the reflector rim 52, as the four alignment protrusions 26 of the disk 12 provide mechanical support on the reflector 50 to enable the structure to withstand external loads.

Referring now to FIGS. 8-12A, another embodiment of a clip 113 of a radome assembly 110 is shown therein. The clip 113 has a main body 114 with central ribs 115. Two flexible fingers 116 with hooks 117 extend from one edge of the main body 114. A securing wall 118 is spaced from the ribs 115 to form a groove 119.

As can be seen in FIGS. 10-12A, the clip 113 can be used to secure the radome assembly described above to a reflector 150. In this instance, the clip 113 can be slipped into one of the cutaway areas 154 in the rim 152 of the reflector 150, with the groove 119 receiving the shorter portion of the rim 152 defining the cutaway area 154. In this position, the hooks 117 of the fingers 116 extend radially outwardly. As such, a radome assembly 110 with a ring 111 having circumferential slots 112 can be attached to the reflector 150 with the clip 113 by pushing the radome 110 into place on the reflector 150 until the hooks 117 snap into the slots 112 to capture the reflector 150.

Figure 13:
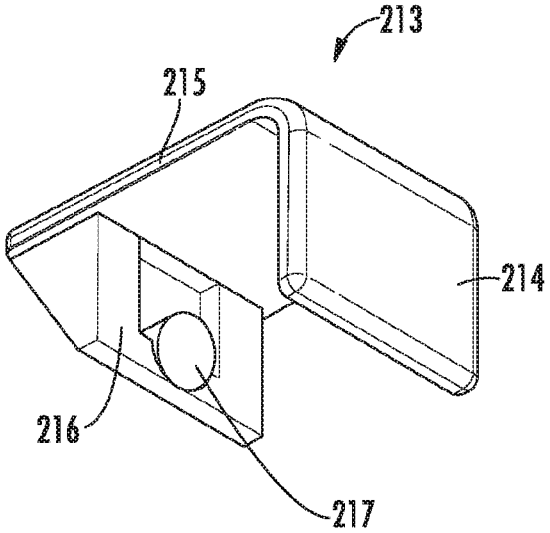
FIG. 13 is a bottom perspective view of a clip used to secure a radome assembly and a reflector according to additional embodiments of the invention.
Figure 14:
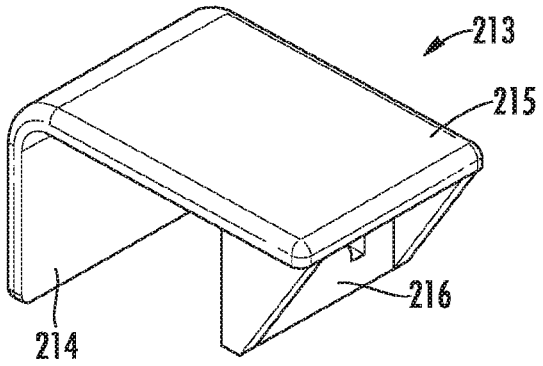
FIG. 14 is a reverse bottom perspective view of the clip of FIG. 13.
Figure 15:
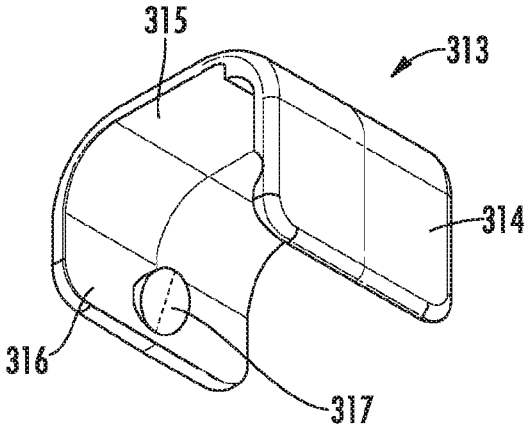
FIG. 15 is a bottom perspective view of a clip used to secure a radome assembly and a reflector according to further embodiments of the invention.
Figure 16:
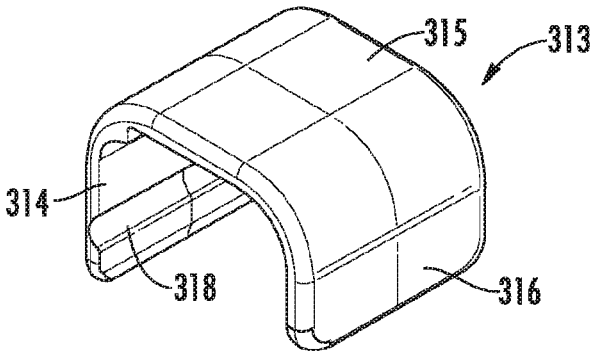
FIG. 16 is a reverse bottom perspective view of the clip of FIG. 15.
Figure 17:
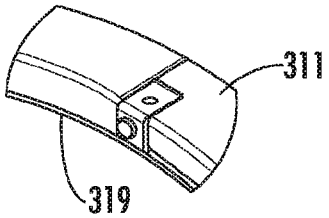
FIG. 17 is a partial perspective view of an annular ring of a radome assembly to be used with the clip of FIG. 15.

Additional embodiments of clips for securing a radome assembly to a reflector are shown in FIGS. 13-17. FIGS. 13 and 14 illustrate a clip 213 that has a front wall 214, a side wall 215 and a rear wall 216 that includes a forwardly-extending pin 217. The clip 213 can be employed to secure a radome assembly to a reflector by inserting the pin 217 into a pre-formed hole in the rim of the reflector, then rotating the clip 213 into place so that the front wall 214 captures the front surface of the annular ring of the radome. Alternatively, FIGS. 15 and 16 illustrate a clip 313 of similar shape, with front, side and rear walls 314, 315, 316 and a pin 317, but the clip 313 includes a recess 318 that can capture a rib 319 in the front surface of the annular ring 311 (see FIG. 17). In either instance, the pins 217, 317 may be canted at an angle to the reflector rim to inhibit inadvertent removal.

Figure 18A:
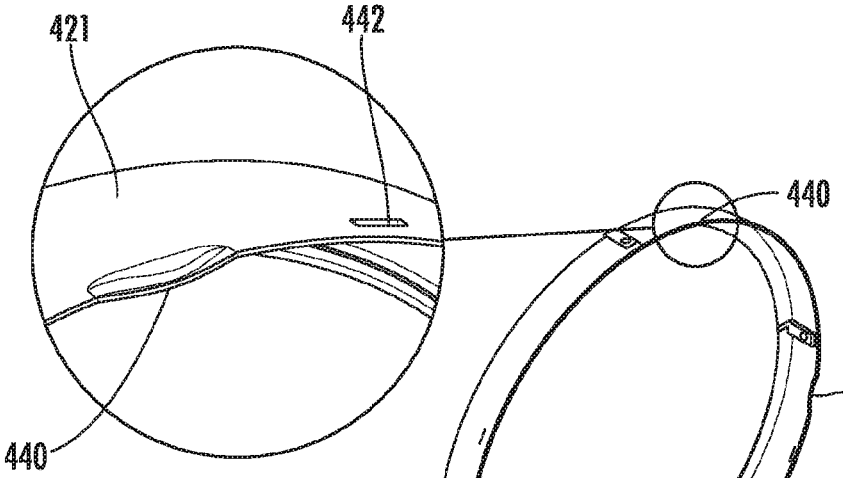
FIG. 18A is an enlarged partial perspective view of a beam and an indentation of the ring of FIG. 18.
Figure 18:
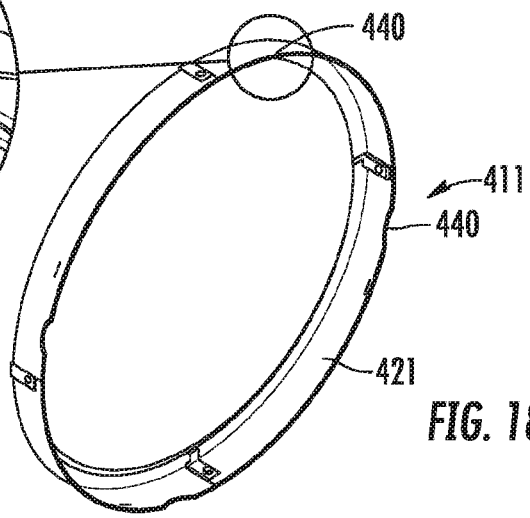
FIG. 18 is a perspective view of an annular ring of a radome assembly according to further embodiments of the invention.

Referring now to FIGS. 18 and 18A, a ring 411 for a radome assembly may be assembled to a reflector without the use of clips. As shown in FIG. 18A, the metal ring 411 includes four inset beams 440; each beam 440 is fixed to the side panel 421 at both ends and extends radially inward from the perimeter of the ring 411. The beam 440 has a V-shaped cross-section. A radome including the ring 411 can be attached to a reflector by aligning the beams 440 with the cutaway areas in the reflector, then rotating the radome relative to the reflector so that the beams 440 are positioned under the reflector and can capture it. The V-shaped cross-section of the beam 440 can facilitate axial advancement of the radome onto the reflector.

In some embodiments, after the radome has been rotated relative to the reflector, it can be secured from further rotation by an indentation 442 in the ring 411 that protrudes radially inwardly and extends into one of the cutaway areas of the reflector. The indentation 442 may either be pre-formed in the ring 411, or may be formed after the radome has been forced onto the reflector and rotated into place.

Figure 19A:
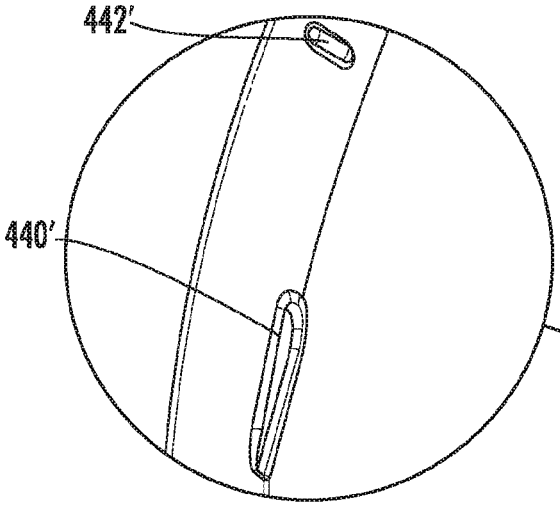
FIG. 19A is an enlarged partial perspective view of a beam and an indentation of the ring of FIG. 19.
Figure 19:
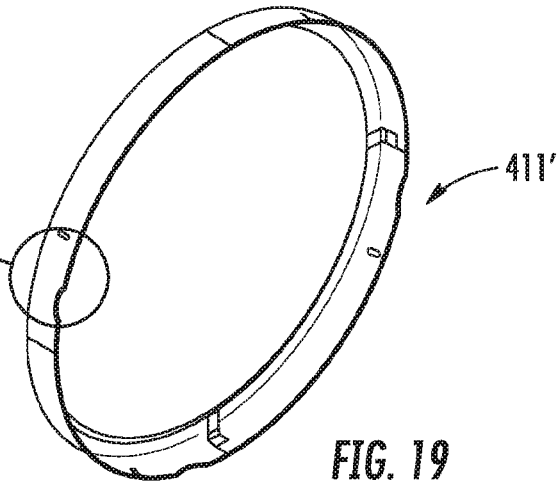
FIG. 19 is a perspective view of an annular ring of a radome assembly according to still further embodiments of the invention.

FIGS. 19 and 19A illustrate an alternative ring 411' that has a beam 440' that is bent more sharply at one end than the other. Also, the ring 411' includes indentations 442' that are oriented axially rather than circumferentially.

Figure 20:
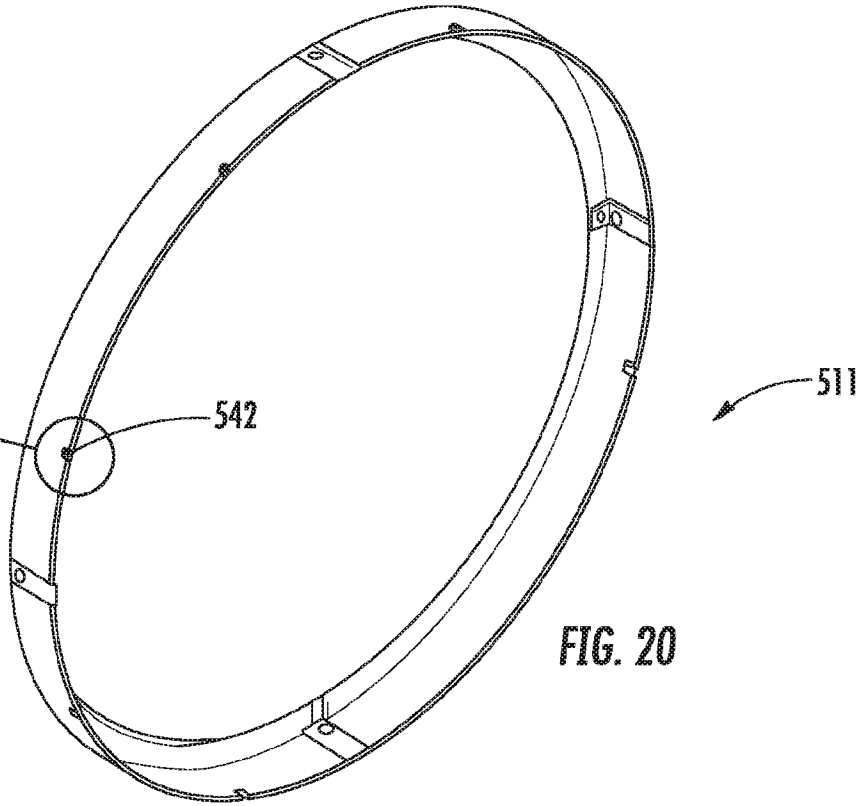
FIG. 20 is a perspective view of an annular ring of a radome assembly according to further embodiments of the invention.
Figure 20A:
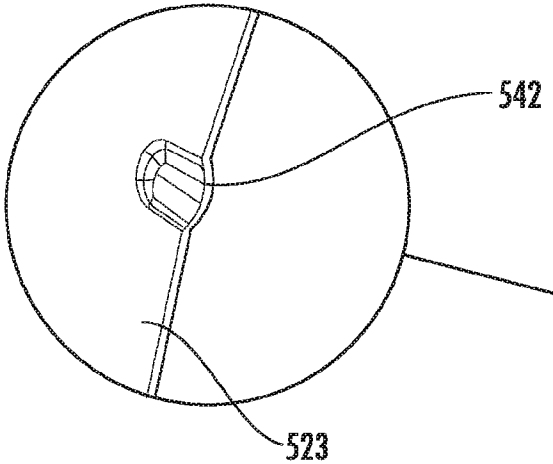
FIG. 20A is an enlarged partial perspective view of an indentation of the ring of FIG. 20.

As an additional alternative embodiment, a radome having a ring 511 may be secured to a reflector by positioning the ring 511 over the reflector, then forming indentations 542 in the lower edge of the side panels 523 of the metal ring 511 (see FIGS. 20 and 20A). The edges of indentations 542 engage the rim of the reflector, thereby securing the reflector to the radome.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

That which is claimed is:

1. A radome-reflector assembly, comprising:

a generally domed reflector having a peripheral rim; and a radome assembly attached to the reflector, the radome assembly comprising:

an annular ring having a front wall and a side wall;

a disk that fits within the ring; and an RF-compliant absorber;

wherein the rim of the reflector fits within the side wall; and further comprising a clip that engages the reflector rim and the ring to secure the reflector to the radome assembly, wherein the clip comprises a capture member extending forwardly from a rear edge of the ring side wall such that an inner surface of the capture member faces the ring side wall, and wherein the capture member is configured to contact the reflector rim and deflect toward the ring side wall and then recover to an undeflected position as the radome assembly is attached to the reflector.

2. The assembly defined in claim 1, wherein the clip includes a front wall that overlies the front wall of the ring, and a side wall that overlies the side wall of the ring, and wherein the capture member secures the reflector relative to the radome assembly.

3. The assembly defined in claim 2, wherein the clip includes hooks that grip an underside of the front wall of the ring.

4. The assembly defined in claim 2, wherein the capture member comprises a flexible finger.

5. The assembly defined in claim 2, wherein the capture member extends through a hole in the ring.

6. The assembly defined in claim 2, wherein the capture member extends through an opening in the rim of the reflector.

7. The assembly defined in claim 1, wherein the clip includes a groove that receives the rim of the reflector.

* * * * *